US005121882A

United States Patent [19]

Skidmore

[11] Patent Number: 5,121,882

[45] Date of Patent: Jun. 16, 1992

[54] MIST APPARATUS FOR SUNBATHING

[76] Inventor: Milus R. Skidmore, 105 Harbor Village Dr., #2, Memphis, Tenn. 38103

[21] Appl. No.: 777,493

[22] Filed: Oct. 15, 1991

Related U.S. Application Data

[63] Continuation of Ser. No. 670,366, Mar. 14, 1991, abandoned, which is a continuation of Ser. No. 382,539, Jul. 19, 1989, abandoned.

[51] Int. Cl.[5] ..... B05B 1/20; B05B 15/08

[52] U.S. Cl. ..... 239/269; 239/273; 239/289; 239/536; 239/562

[58] Field of Search ..... 239/266, 269, 273, 279, 239/289, 536, 550, 562, 567, 569, DIG. 1

[56] References Cited

U.S. PATENT DOCUMENTS

| | | | |
|---|---|---|---|
| 648,263 | 4/1900 | Hull | 239/269 |
| 1,914,850 | 6/1933 | Foster | 239/269 |
| 2,770,812 | 11/1956 | Whiteside | 239/289 |
| 3,185,397 | 5/1965 | Nelson | 239/567 |
| 3,625,434 | 12/1971 | Kitover | 239/289 |
| 3,688,775 | 9/1972 | Raymann . | |
| 4,548,357 | 10/1985 | Schmidt | 239/289 |
| 4,778,111 | 10/1988 | Leap | 239/562 |
| 4,925,099 | 5/1990 | Owen | 239/289 |
| 4,974,779 | 12/1990 | Araki et al. | 239/DIG. 1 X |

FOREIGN PATENT DOCUMENTS

| | | | |
|---|---|---|---|
| 707574 | 4/1954 | United Kingdom | 239/273 |
| 2181973 | 5/1987 | United Kingdom | 239/289 |

*Primary Examiner*—Andres Kashnikow
*Assistant Examiner*—William Grant
*Attorney, Agent, or Firm*—Grant E. Pollack

[57] ABSTRACT

An apparatus for delivering a water mist to sunbathers comprising: a pair of pipe sections having perforations along the lengths thereof for mounting mist producing nozzles, a flexible hose connecting the pipes one to the other, and a valve at an inlet to the pipe assembly for controlling the flow of water through the pipes. A cap at one end of the apparatus seals the pipe assembly and causes water flowing into the pipes to be forced through the nozzles, thereby producing a fine mist. The flexible hose not only permits adjustment of the distance between the pipes to facilitate use by a number of sunbathers, but also enables the apparatus to be folded for transportation or storage.

13 Claims, 1 Drawing Sheet

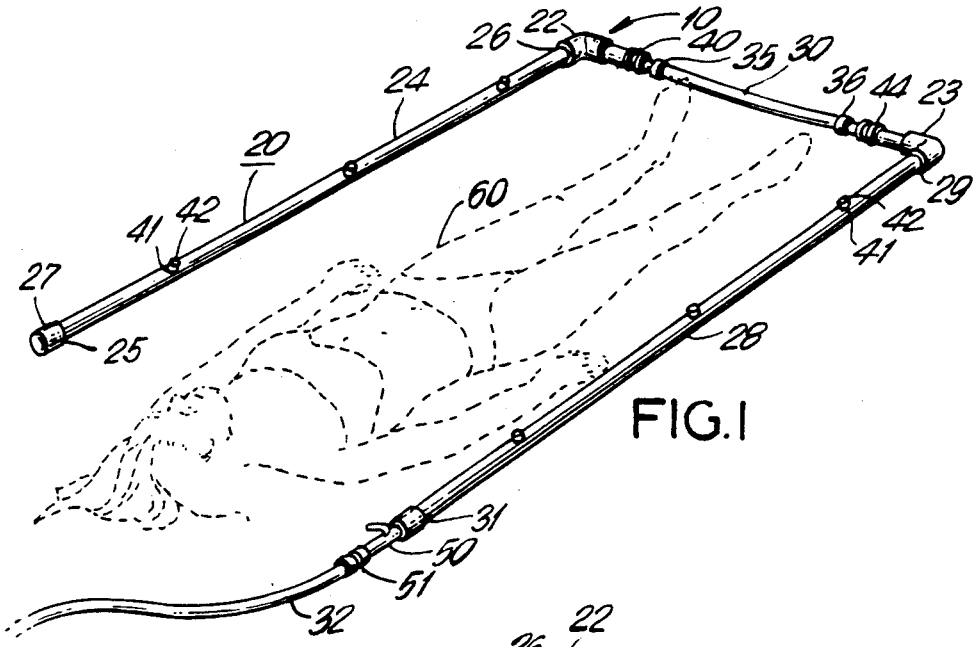
FIG. 1
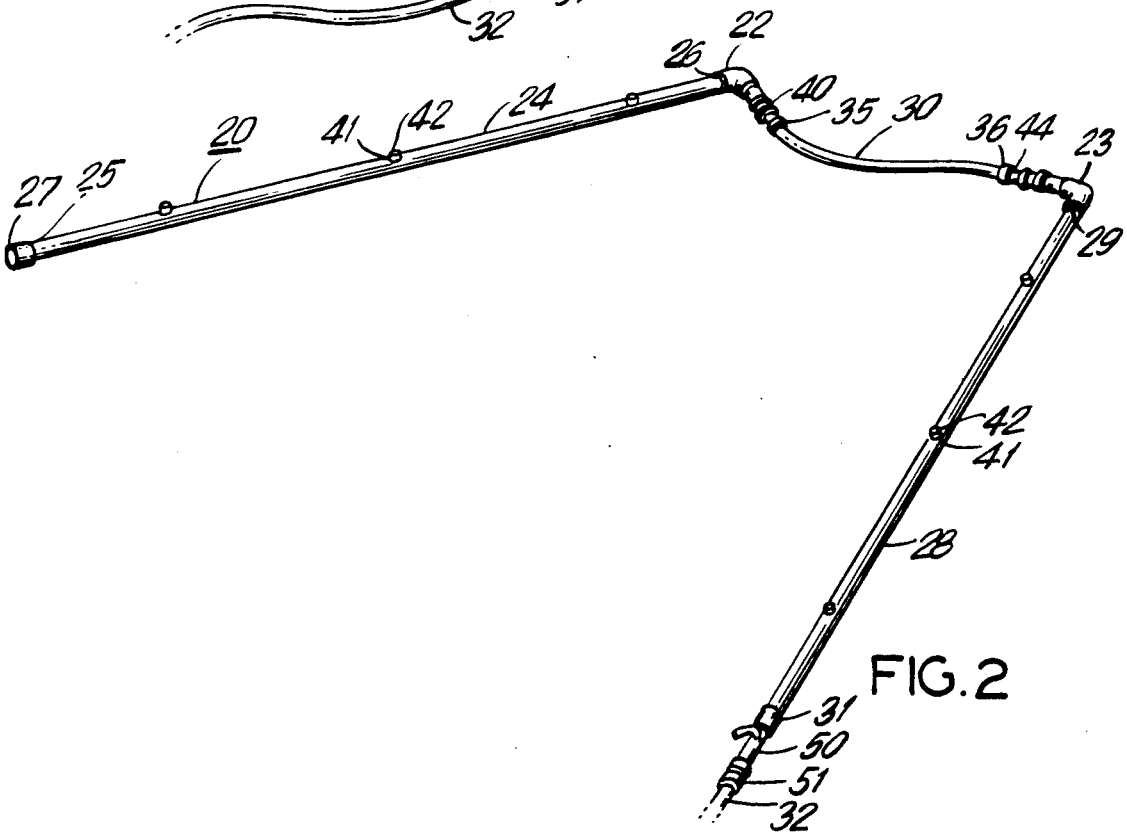
FIG. 2
FIG. 3
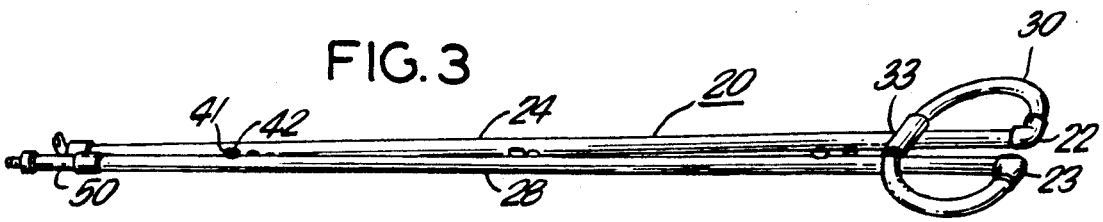

MIST APPARATUS FOR SUNBATHING

This application is a continuation of application Ser. No. 670,366, filed Mar. 14, 1991, now abandoned, which is a continuation of application Ser. No. 382,539, filed Jul. 19, 1989, now abandoned.

BACKGROUND OF THE INVENTION

This invention relates to devices for cooling sunbathers. More specifically, the invention relates to an apparatus for delivering a water mist to a sunbather's body.

To obtain a dark, satisfying suntan, a sunbather must spend prolonged periods in the sun. However, this causes a rise in skin and body temperature which often results in pain and discomfort. Consequently, it is desirable to use a sprinkling device to spray water on sunbathers to cool them off during tanning. Such sprinkling apparatus commonly take the form of a lawn chair or other leisure recliner having a hollow, leak-proof frame. The tubular frame has holes along its length so that upon circulation of water through the frame, water is forced through the holes, resulting in a water spray. The holes are suitably oriented for sprinkling water upon a sunbather lying on the recliner. Other sprinkling apparatus utilize a garden hose having similar perforations and being affixed to the periphery of the lawn chair frame to accomplish a like result.

However, these sunbathing apparatus have disadvantages which limit their use and effectiveness. In particular, not only is it costly to combine a sprinkling device with a lawn chair, but also these devices are cumbersome to store and transport. In addition, the holes or perforations in these apparatus for emitting a water spray too often drench rather than merely cool the sunbather. Other disadvantages include the limitation that only one sunbather ordinarily fits on a single lawn chair at one time and the inability of the sunbather to control the quantity of mist emitted.

Accordingly, it is desirable that sprinkling apparatus for sunbathers be portable for ready transportation to the yard or beach and be adaptable for use by a number of sunbathers. It is also desirable that the quantity of water be controllable to maintain comfort during the tanning process and that the apparatus be economical to purchase and operate.

SUMMARY OF THE INVENTION

In accordance with one aspect of the present invention, there is provided an apparatus for delivering a mist to sunbathers comprising a series of interconnected pipes having perforations along the lengths thereof for mounting mist producing nozzles. The flow of water through the pipes is controlled by a valve at an inlet to the pipe assembly. A cap at the other end of the series of pipes seals the pipe assembly and causes water flowing into the pipes to be forced through the nozzles thereby generating a fine mist. The pipes are connected by a flexible hose which permits adjustment of the distance between the pipes; the flexible hose may be bent to vary the angle and distance between the pipes to facilitate use by a number of sunbathers simultaneously. The hose also enables the apparatus to be folded-up for transportation or storage.

Accordingly, it is an object of the present invention to provide an apparatus which delivers a fine mist for the comfortable and efficient cooling of one or more sunbathers.

Another object of the present invention is to provide an economical apparatus which is easily folded for transportation and storage.

Still other objects and advantages of the present invention will become apparent in the following description of the preferred embodiments.

BRIEF DESCRIPTION OF THE DRAWINGS

The invention will be better understood from the following description taken in conjunction with the appended drawings in which:

FIG. 1 is a perspective view depicting the mist apparatus of the present invention;

FIG. 2 is a perspective view of the apparatus of FIG. 1 in an extended position; and FIG. 3 is a side view of apparatus of FIG. 1 in a folded position.

DETAILED DESCRIPTION OF A PRESENTLY PREFERRED EMBODIMENT

Referring now more particularly to the accompanying drawings, wherein like numerals designate similar parts throughout the various sections, attention is directed first to FIG. 1 wherein the apparatus of the present invention is designated generally by reference number 10. More specifically, mist apparatus 10 comprises a pipe assembly 20, a flexible hose 30 and a valve 50.

In the presently preferred embodiment, the pipe assembly 20 includes a pair of pipe sections 24 and 28 suitable for use by a sunbather 60, as shown in FIG. 1. In particular, each pipe section 24 and 28 mounts an elbow 22 and 23, respectively, which facilitates the connection of the respective pipe sections to flexible hose section 30 to give the apparatus a U-shape.

Pipe section 24 includes a cap 27 at end 25 for restricting flow through the pipe. Elbow 22 at end 26 has a connector or fitting 40 for attaching the elbow to one end of flexible hose section 30. Pipe section 28 has an end 29 joining elbow 23. Elbow 23 includes a connector 44 for joining the elbow to the other end of the hose 30. End 31 of pipe section 28 mounts variable flow valve 50, which valve controls the flow of water into the apparatus 10. The valve 50 is, in turn, connected to an external source of water 32, for example a garden hose attached to a faucet, using a connector or fitting 51 and serves as an inlet to the pipe assembly 20.

Each pipe section has a plurality of holes 41 circumferentially aligned at intervals along its length. Each hole mounts a nozzle 42 of a type which produces a fine mist when water flows therethrough. The holes along the pipes are suitably oriented so as to direct each nozzle inward toward the sunbathers during use, as shown in FIGS. 1 and 2.

Each end of the hose section 30 has an adapter 35 and 36 for connecting the hose to each of the first and second pipe section connectors 40 and 44, respectively. Connectors 40 and 44 are suitably shaped to receive the adapters and create a leak-proof seal therebetween.

In operation, water enters the series of pipes through the valve and inlet, flowing until it reaches the pipe end cap. The water, being restricted from flowing further, is thereby forced through the nozzles to generate a fine mist. The rate of flow of water is controlled by the valve and that rate determines the range of the mist produced. The valve preferably is of a type which permits a gradual variation of flow between a full flow or "ON" position and an "OFF" position.

For transportation or storage, pipe sections 24 and 28 may be placed side-by-side by bending hose 30 into a loop, as shown in FIG. 3. The hose may then be tied down by using string 33 or other suitable fasteners.

The apparatus may also be used simultaneously by a number of sunbathers. This may be accomplished by moving the pipes outwardly from their initial parallel or U-shaped position through radial movement of pipe ends 25 and 31 about the flexible hose. As shown in FIG. 2, the apparatus is now disposed generally in an M-shape. In this configuration the apparatus is suitable for use by two or more sunbathers.

Although the present invention has been described and shown as having a pair of pipes joined by a hose in a U-shape and disposed in a horizontal position, it is understood that it may comprise any number of pipe sections and elbows which permit assembly in a variety of different pathway shapes. In addition, the apparatus may be oriented in any convenient position. It has been found, however, that the U-shaped configuration of the present embodiment positioned on a horizontal surface, as shown in FIG. 1, not only results in good stability of the apparatus but also facilitates practical use by sunbathers.

The apparatus of the present invention may also be constructed of a variety of different materials. However, one should keep in mind when selecting the materials to be used the stresses to which the apparatus will be subjected during operation. For example, it has been found that PVC pipe can be efficiently shaped and molded into pipe sections while maintaining durability without undue weight and cost. In addition, the hose section may consist of a garden hose or any other flexible material suited to the environment in which it is to be used.

It has also been found that Monarch M-1® type nozzles are suitable for producing the very fine mist desired by the presently preferred embodiment. Furthermore, it has been found that a flow rate of 0.6 gallons/hour through each nozzle is suitable for producing this fine mist. Although these features are desirable, it should be understood that any flow rate, pipe diameter and nozzle combination which produces a fine water mist could be utilized.

Since, from the foregoing, the construction and advantages of the device may be readily understood, further explanation is believed to be unnecessary. However, since numerous modifications will readily occur to those skilled in the art after a consideration of the foregoing specification and accompanying drawings, it is not intended that the invention be limited to the exact construction shown and described, but all suitable modifications and equivalents may be resorted to which fall within the scope of the appended claims.

What is claimed is:

1. A sprinkling apparatus for sunbathing comprising:

a plurality of pipe sections interconnected so as to form a pipe system for receiving a fluid flow, at least two of said pipe sections being rigid and being separated a selected distance from one another, a first of said rigid pipe sections having an inlet for communicating with a fluid supply, a second of said rigid pipe sections being provided with means for restricting flow of fluid from said pipe system;

said pipe system having means for controlling the flow of fluid from said fluid supply to said plurality of pipe sections, means for adjusting the distance between said pipe sections so as to facilitate use by a plurality of sunbathers, means for joining at least two of said pipe sections with said adjusting means so as to provide a leakproof seal therebetween; and a plurality of raised nozzles for producing an ultra fine mist upon circulation of said fluid through said pipe sections;

wherein said adjusting means includes a flexible hose securely joining one of said pipe sections with another so as to facilitate the distribution of mist over a selected area and enable use of said apparatus by a plurality of sunbathers.

2. The apparatus set forth in claim 1 wherein said control means includes a valve associated with said inlet for varying the flow rate of said fluid through said pipe sections.

3. The apparatus set forth in claim 1 wherein said restricting means includes a cap for sealing one and of said pipe system from leakage of said fluid.

4. The apparatus set forth in claim 1 wherein said inlet includes a first connector for securing said first rigid pipe section to said fluid supply so as to form a leakproof seal.

5. The apparatus set forth in claim 1 wherein each of said pipe sections have perforations adapted for receiving said raised nozzles, said perforations being positioned along said pipe sections in a selected orientation so as to direct said nozzles toward said sunbather.

6. The apparatus set forth in claim 1 wherein said joining means includes second connectors for securing said pipe sections to one another so as to form a fluid flow network of pipe sections.

7. A sprinkling apparatus for sunbathing comprising:

a plurality of tube members interconnected end to end so as to form a tube system for receiving a fluid flow, at least two of said members being rigid and being separated a selected distance from one another, a first of said members having an inlet for communication with a fluid supply, a second of said members having means for restricting flow of fluid form said tube system;

said tube system having means for controlling the flow of fluid from said fluid supply to said tube system, means for adjusting the distance between said tube members so as to facilitate use by a plurality of sunbathers, means for joining at least two of said tube members with said adjusting means so as to provide a leakproof seal therebetween; and a plurality of raised nozzles in each rigid member for producing an ultra fine mist upon circulation of said fluid through said tube system;

wherein said adjusting means includes a flexible tube member securely connecting one of said tube members to another to facilitate the distribution of said mist over a selected area and enable use of said apparatus by said plurality of sunbathers.

8. The apparatus set forth in claim 7 wherein said control means includes a valve associated with said inlet for varying the flow rate of fluid through said tube system.

9. The apparatus set forth in claim 7 wherein said restricting means includes a cap at one end of said second member for restricting passage of fluid from said tube system.

10. The apparatus set forth in claim 7 wherein said inlet includes a first connector for securing said first member to said fluid supply so as to form a leak-proof seal.

11. The apparatus set forth in claim 7 wherein each of said tube members includes perforations adapted for receiving said raised nozzles, said perforations being oriented along each tube member so as to direct the nozzles toward said sunbathers.

12. The apparatus set forth in claim 7 wherein said joining means includes second connectors for securing said tube members end to end so as to form a fluid flow network of tube members.

13. A method of sprinkling a mist of fluid over a plurality of sunbathers, which comprises the steps of:

(a) placing a tube system having a plurality of rigid tube members connected end to end with a flexible tube member on a relatively flat surface;

(b) moving the rigid tube members outwardly and about the flexible tube member so that the tube system surrounds a selected number of sunbathers; and (c) circulating fluid through the tube system so as to spray the fluid mist from nozzles mounted in the rigid tube members over the sunbathers.

* * * * *